US005856077A

United States Patent [19]

Dickerson et al.

[11] Patent Number: 5,856,077

[45] Date of Patent: Jan. 5, 1999

[54] SINGLE SIDED MAMMOGRAPHIC RADIOGRAPHIC ELEMENTS

[75] Inventors: Robert E. Dickerson, Hamlin; Patrick M. Jeffries, Pittsford; Marcia K. Hansen, Fairport, all of N.Y.

[73] Assignee: Eastman Kodak Company, Rochester, N.Y.

[21] Appl. No.: 911,483

[22] Filed: Aug. 14, 1997

[51] Int. Cl.[6] ..... G03C 5/16; G03C 1/825; G03C 1/09; G03C 1/035

[52] U.S. Cl. ..... 430/510; 430/966; 430/605; 430/567; 430/438

[58] Field of Search ..... 430/502, 508, 430/509, 966, 605, 510, 567, 438

[56] References Cited

U.S. PATENT DOCUMENTS

| | | | |
|---|---|---|---|
| 4,710,637 | 12/1987 | Luckey et al. | 250/486.1 |
| 4,803,150 | 2/1989 | Dickerson et al. | 430/502 |
| 5,108,881 | 4/1992 | Dickerson et al. | 430/502 |
| 5,449,599 | 9/1995 | Heremans | 430/567 |
| 5,470,700 | 11/1995 | Marui | 430/567 |
| 5,639,591 | 6/1997 | Adachi | 430/567 |
| 5,716,774 | 2/1998 | Dickerson et al. | 430/571 |
| 5,759,754 | 6/1998 | Dickerson | 430/502 |

OTHER PUBLICATIONS

Science and Technology of Photography, VCH, New York 1993, p. 40, ed. Karlheinz Keller.

*Primary Examiner*—Mark F. Huff
*Attorney, Agent, or Firm*—Carl O. Thomas

[57] ABSTRACT

A mammographic medical diagnostic radiographic element is disclosed that produces sharp images and is capable of being processed in less than 60 seconds. Each of imaging and antihalation fully forehardened hydrophilic colloid layer units are coated on the opposite sides of a transparent film support at a hydrophilic colloid coating coverage of less than 55 mg/dm$^2$. The radiation-sensitive silver halide grains contained in the imaging layer unit are provided by a tabular grain emulsion coated at a coverage capable of providing a maximum density on processing of greater than 3.6. To provide a mid-scale contrast of greater than 3.0 and a lower scale contrast of greater than 2.2, the radiation-sensitive grains (a) exhibit an equivalent circular diameter coefficient of variation grain of less than 15 percent and (b) contain rhodium in a normalized molar concentration of less than $1\times10^{-6}$ based on silver.

7 Claims, No Drawings

SINGLE SIDED MAMMOGRAPHIC RADIOGRAPHIC ELEMENTS

FIELD OF THE INVENTION

The invention relates to radiographic elements containing radiation-sensitive silver halide grains intended to be exposed by an intensifying screen.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "normalized molar concentration" in referring to rhodium concentrations based on silver, indicates the number of gram-molecular weights of rhodium present per gram-molecular weight of silver, divided (normalized) by the number of rhodium atoms present in the rhodium containing molecule.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The term "coefficient of variation" or "COV" is defined as the standard deviation ($\sigma$) of grain ECD divided by mean grain ECD. COV is multiplied by 100 when stated as a percentage.

The term "log E" represents the log of exposure in lux-seconds.

The term "mid-scale contrast" or "MSC" is defined as the slope of a line drawn between characteristic curve points at densities above minimum density ($D_{min}$) of 0.25 and 2.0.

The term "lower scale contrast" or "LSC" is defined as the slope of a line drawn between a characteristic curve first reference point at a density of 0.85 above minimum density and a second, lower exposure reference point on the characteristic curve separated from the first reference point by an exposure difference of 0.3 log E.

The terms "front" and "back" in referring to radiographic imaging are used to designate locations nearer to and farther from, respectively, the source of X-radiation than the support of the radiographic element.

The term "single sided" refers to a radiographic element coating format in which radiation-sensitive silver halide grains are coated on only one side of a support.

The term "dual coated" refers to a radiographic element coating format in which radiation-sensitive silver halide grains are coated on both sides of a support.

The term "overall processing" refers to processing that occurs between the time an imagewise exposed element is introduced into a processor and the time the element emerges dry. The processing steps include development, fixing, washing and drying.

The term "rapid access processing" refers to overall processing in less than 90 seconds.

The term "fully forehardened" means that the hydrophilic colloid layers of a radiographic element are forehardened in an amount sufficient to reduce swelling of these layers to less than 300 percent, percent swelling being determined by (a) incubating the radiographic element at 38° C. for 3 days at 50 percent relative humidity, (b) measuring layer thickness, (c) immersing the radiographic element in distilled water at 21° C. for 3 minutes, and (d) determining the percent change in layer thickness as compared to the layer thickness measured in step (b).

*Research Disclosure* is published by Kenneth Mason Publications, Ltd., Dudley House, 12 North St., Emsworth, Hampshire P010 7DQ, England.

BACKGROUND

In medical diagnostic imaging X-radiation is passed through a portion of a patient's anatomy. The pattern of X-radiation that passes through the patient is recorded in one or more radiation-sensitive emulsion layers of a radiographic film.

There is no single radiographic element that adequately serves all medical diagnostic needs. The degree to which X-radiation is absorbed varies widely from one anatomical region to the next. For example, lungs, which are filled with air, absorb relatively low levels of X-radiation while much higher levels of X-radiation are absorbed in heart imaging. Also, the feature sought for observation can either differ markedly in its X-radiation absorption from adjacent anatomy, such as a clean break in a bone, or can differ only slightly, such as a lesion or anomaly in soft tissue.

Mammographic diagnostic needs challenge radiographic imaging capabilities. An advanced tumor or cancer can be easily identified, but the diagnostic goal, to maximize survival rates, is to identify cancerous and pre-cancerous growths at the earliest possible stage of development. This is a challenge, since the anatomical feature being sought is, in its earliest stages, a tiny microcalcification and the difference in X-radiation absorption between that feature and healthy tissue is not large.

The types of radiographic elements most generally used for medical diagnostic imaging employ tabular grain emulsions, usually coated on both sides of a transparent film support—i.e., dual coated. Tabular grain emulsions offer many advantages, including the following particularly relevant advantages: increased covering power (allowing reductions in silver coating coverages) and resistance to covering power loss as a function of increased hardening (allowing radiographic elements to be fully forehardened, thereby simplifying processing).

Attempts have been made to apply separately and together tabular grain emulsions and dual coated formats to mammographic imaging applications, both illustrated by Luckey et al U.S. Patent No. 4,710,637. Unfortunately, the performance of radiographic elements containing tabular grain emulsions has not met the high performance requirements necessary for acceptance for mammographic imaging.

Medical diagnostic radiographic elements intended for mammographic imaging that have been most widely accepted by radiologists contain a single radiation-sensitive emulsion layer containing non-tabular silver halide grains. The single sided emulsion coating format maximizes image sharpness as compared to the more generally used dual coated format. The non-tabular silver halide grains allow higher contrasts, particularly higher lower scale contrasts, but, to realize acceptable maximum densities without coating excessive levels of silver, the non-tabular grains require that hardening be completed during processing—i.e., the radiographic elements are only partially forehardened. This results in increased water ingestion into the radiographic element during processing and, as a consequence, limits the extent to which overall processing times can be reduced. Single sided mammographic radiographic elements can be processed in less than 90 seconds, but are incapable of satisfying significantly lower overall processing cycle times. Radiographic element A described as a control in the Examples below is representative of single sided mammographic radiographic elements of the type currently accepted for mammographic medical diagnostic imaging.

The rhodium doping of radiation-sensitive silver halide grains is a known technique for increasing contrast. Keller *Science and Technology of Photography,* VCH, New York, 1993, at page 40 states:

> A fundamentally different approach to high gradation values is the doping of the emulsion grains with heavy-metal ion such as those of rhodium, cadmium, lead and bismuth. Doping pushes back the toe of the characteristic curve and produces a steep gradation.

The expression "pushes back the toe" means simply that more light exposure is required before density rises above a minimum level. In other words, increased contrast is obtained at the price of reduced speed.

Increasing mean grain size is a known technique for increasing imaging speed. Unfortunately, granularity (image noise) increases are an inherent consequence of increasing mean grain size. Attempting medical diagnoses with larger grain sizes and therefore grainy images runs a significant risk of failing to identify the presence of microcalcifications.

PROBLEM TO BE SOLVED

The problem which this invention addresses is the need for medical diagnostic radiographic elements that satisfy the maximum density as well as mid-scale and, particularly, lower scale contrast performance capabilities of conventional mammographic imaging elements while allowing full forehardening to achieve overall processing in less than 60 seconds.

The most straight-forward approach to simultaneously increasing maximum density and contrast is to increase silver coating coverages. Unfortunately, this approach cannot be employed, since, to avoid wet pressure sensitivity, hydrophilic colloid coating coverages must be proportionately increased as silver coating coverages are increased. This increases water ingestion during processing and the drying load placed on the processor. In other words, it is incompatible with shorter overall processing cycles.

In attempting to increase contrast by increasing the coating coverage of tabular grain emulsions, a second, unexpected difficulty was encountered. Tabular grain emulsions show markedly lower increases in lower scale contrast with increasing silver coating coverages as compared to non-tabular grain emulsions. An explanation for this is that the light capture area of tabular grains compared to non-tabular grains at comparable silver coverages is so much higher that overlying tabular grains effectively shield underlying tabular grains for light exposure at low levels of light exposure, which is recorded in the toe region of a characteristic curve. Failure to achieve levels of lower scale contrast acceptable for mammographic imaging by increasing tabular grain emulsion silver coating coverages was unexpected.

Another approach that is known for increasing contrast is to decrease grain size dispersity—i.e., to decrease the COV of mean grain size. As demonstrated in the Examples below, it is not possible to achieve mid-scale or lower scale contrasts of mammographic elements containing tabular grain emulsions merely by lowering grain size COV to the lowest known levels—i.e., employing tabular grain emulsion COV's of less than 10 percent.

SUMMARY OF THE INVENTION

In one aspect this invention is directed to a medical diagnostic radiographic element comprised of a film support capable of transmitting radiation to which the radiographic element is responsive having first and second major surfaces, hydrophilic colloid layer units consisting of an imaging layer unit coated on the first major surface including at least one emulsion containing radiation-sensitive silver halide grains and an antihalation layer unit coated on the second major surface, wherein, to facilitate mammographic imaging with processing times of less than 60 seconds, the layer units are fully forehardened and each exhibits a hydrophilic colloid coating coverage of less than 55 mg/dm$^2$ and the radiation-sensitive silver halide grains are provided by a tabular grain emulsion and coated at a coverage capable of providing a maximum density on processing of greater than 3.6 and, to provide a mid-scale contrast of greater than 3.0 and a lower scale contrast of greater than 2.2, the grains (a) exhibit a coefficient of variation grain equivalent circular diameter of less than 15 percent and (b) contain rhodium in a normalized molar concentration of less than $1\times10^{-7}$ based on silver, mid-scale contrast being measured over a density range above minimum density of from 0.25 to 2.0 and lower scale contrast being measured from a reference density of 0.85 above minimum density to a density provided by an exposure of 0.3 log E less than that providing the reference density, where E represents exposure in lux-seconds.

DESCRIPTION OF PREFERRED EMBODIMENTS

Assembly A

IS Intensifying Screen
SS Screen Support
LE Luminescence Emitting Layer
RE Radiographic Element
IHC Imaging Hydrophilic Colloid Layer Unit
  FSC Front Surface Overcoat
  IL Interlayer
  EL Emulsion Layer(s)
S Support
  S1 Subbing Layer
  TF Transparent Film
  S2 Subbing Layer
AHC Antihalation Hydrophilic Colloid Layer Unit
  PL Pelloid Layer
  BSC Back Surface Overcoat This is an assembly of a mammographic medical diagnostic radiographic element according to the invention positioned an contact with an intensifying screen as occurs during imagewise exposure of the element.

Assembly A consists of an intensifying screen IS and a single sided mammographic medical diagnostic radiographic element RE according to the invention. The intensifying screen and radiographic element, which are separate elements, are shown in the face-to-face relationship in which they are mounted in a cassette during imagewise exposure to X-radiation.

The intensifying screen consists of a screen support SS and a luminescence emitting layer LE. The luminescence emitting layer is typically a coating containing phosphor particles in a polymeric binder. The intensifying screen can take any of the conventional forms known to be useful in mammographic imaging. For specific illustrations, attention is directed to Haus, "Physical Principles and Radiation Does in Mammography", *Medical Radiography and Photography,* Vol. 58, No. 3, pp. 70–83, published by Eastman Kodak Company, Rochester, N.Y. 14650.

In use, a uniform field of X-radiation is directed toward breast tissue sought to be examined. X-radiation that passes through to the intensifying screen has been imagewise modulated by the non-uniformity of absorption within the breast tissue. The X-radiation reaching the intensifying screen is absorbed by phosphor particles within the luminescence emitting layer and the luminescence emitting layer emits light a pattern corresponding to the pattern of X-radiation received. Light emitted by the intensifying screen imagewise exposes and produces a developable latent image in the emulsion layer or layers EL.

Light that passes through the imaging hydrophilic colloid layer unit IHC also passes unabsorbed through the subbing layers S1 and S2 and transparent film TF forming support S, and is absorbed within the pelloid layer PL of the antihalation hydrophilic colloid layer unit AHC. The antihalation colloid layer unit is necessary to prevent image sharpness degradation within the emulsion layer or layers by reflected light.

Following imagewise exposure, the radiographic element is separated from the intensifying screen by removal from the cassette and processed in a conventional rapid access processor to transform the latent image stored in the emulsion layer or layers into a viewable image. For reasons more fully discussed below the unique construction of the mammographic medical diagnostic radiographic element of the invention allows overall processing in less than 60 seconds, as compared to the standard 90 second processing cycle required by conventional single sided mammographic elements in current use.

The mammographic elements of the invention are superior to mammographic elements that have heretofore available in the art in that they provide a combination of advantageous characteristics never previously realized in a single mammographic radiographic element:

(1) Extremely sharp images.

(2) High levels of sensitivity.

(3) Full forehardening.

(4) Maximum image densities of greater than 3.6.

(5) Processing in less than 60 seconds.

(6) Low wet pressure sensitivity.

(7) A mid-scale contrast of greater than 3.0 and a lower scale contrast of greater than 2.2.

The individual components of the mammographic radiographic elements of the invention and their contributions to this unique combination of features and performance capabilities is described below.

The support S of the radiographic element RE can take the form of any conventional transparent film support for radiographic elements. Typically the support is either colorless or blue tinted, tinting dye being present in any one or combination of the transparent film TF and subbing layers S1 and S2. Neither the subbing layers nor the transparent film ingest water during processing. Subbing layers are commonly provided to facilitate adhesion of the hydrophilic colloid layer units, but are not required for all types of transparent films. Any of the transparent photographic film supports disclosed in *Research Disclosure,* Vol. 389, September 1996, Item 38957, Section XV. Supports, particularly paragraph (2), which describes subbing layers, and paragraph (7), which describes preferred polyester film supports. Conventional radiographic film supports, including blue tinting dyes, are described in Research Disclosure, Vol. 184, August 1979, Item 18431, XII. Film Supports.

To facilitate overall processing in less than 60 seconds, feature (5) above, the imaging hydrophilic colloid layer unit IHC coated on the front side of the support and the antihalation hydrophilic colloid layer unit coated on the back side of the support are each fully forehardened, feature (3), and contain a hydrophilic colloid coating coverage of less than 55 mg/dm$^2$. Full forehardening limits water ingestion during processing and thereby allows shorter process times to be realized. Full forehardening also better protects the radiographic elements from damage during handling and processing than when final hardening is completed in the processor. Dickerson U.S. Patent No. 4,414,304 describes the full forehardening of tabular grain emulsions for use in radiographic elements. The levels of forehardening of a fully forehardened radiographic element are similar to those employed in forehardening photographic elements. A summary of vehicles for photographic elements including hydrophilic colloids, employed as peptizers and binders, and useful hardeners is contained in *Research Disclosure,* Item 38957, Section II. Vehicles, vehicle extenders, vehicle-like addenda and vehicle related addenda. Preferred vehicles for the hydrophilic colloid layer units are gelatin (e.g., alkali-treated gelatin or acid-treated gelatin) and gelatin derivatives (e.g., acetylated gelatin or phthalated gelatin). Although conventional hardeners can be used more or less interchangeably with little or no impact on performance, particularly preferred are the bis(vinylsulfonyl) class of hardeners, such as bis(vinylsulfonyl)alkylether or bis (vinylsulfonyl)alkane hardeners, where the alkyl moiety contains from 1 to 4 carbon atoms.

For antihalation protection, a necessary contributor toward achieving feature (1) above, the pelloid layer PL incorporates one or a combination of antihalation dyes to absorb light emitted by the intensifying screen that passes through the imaging hydrophilic colloid layer unit and the support. As is conventional practice in radiography and photography, the antihalation dye or dyes are chosen to be substantially decolorized during processing. Any conventional processing solution decolorizable antihalation dye can be employed in the radiographic elements of the invention. Suitable antihalation dyes are disclosed in *Research Disclosure,* Item 38957, VIII. Absorbing and scattering materials, B. Absorbing materials.

In addition to providing the antihalation protection the antihalation layer unit AHC is usually also employed to protect the radiographic element from unwanted curl. Thus, the typical construction is to match at least approximately the coating coverage of hydrophilic colloid in the antihalation layer unit to that present in the imaging hydrophilic colloid layer unit IHC.

The imaging hydrophilic colloid layer unit IHC contains radiation-sensitive silver halide grains provided by one or more tabular grain emulsions. When two or more emulsions are employed, they can be blended or coated in separate emulsion layers. In a preferred form of the invention a single tabular grain emulsion is employed coated in a single emulsion layer. Tabular grain emulsions are essential to achieving characteristics (1)–(7) in combination. Conventionally employed non-tabular grain emulsions do not equal characteristics (1) and (2) and are incapable of to allowing characteristics (3) and (5) to be realized.

Tabular grain silver halide emulsions contemplated for use in the practice of the invention can be of any of the following silver halide compositions: silver chloride, silver bromide, silver iodobromide, silver chlorobromide, silver bromochloride, silver iodochloride, silver iodochlorobromide and silver iodobromochloride, where the mixed halides are named in order of ascending concentrations. Since it is recognized that the presence of iodide slows grain development, it is advantageous to choose emulsions that contain no iodide or only limited levels of iodide. Iodide concentrations of less than 4 mole percent, based on silver, are specifically preferred. Of the three photographic halides (chloride, bromide and iodide), silver chloride has the highest solubility and hence lends itself to achieving the highest rates of development. It is therefore preferred in terms of achieving characteristic (5). When characteristics (5) and (2) are considered together, silver chlorobromide and silver bromide compositions are preferred.

To most conveniently realize characteristic (7) and to realize characteristic (4) with low silver coating coverages the tabular grain emulsions are chosen so that tabular grains having thicknesses of less than 0.3 $\mu$m, preferably less than 0.2 $\mu$m, in thickness account for greater than 70 percent and preferably at least 90 percent of total grain projected area. Although the covering power the tabular grains increases as their thickness is decreased, it is usually preferred to maintain average tabular grain thicknesses of at least about 0.1 $\mu$m to avoid undesirably warm image tones in the fully processed mammographic images. To avoid excessive granularity and hence high levels of image noise incompatible with identifying microcalcifications in mammographic images, it is contemplated to employ tabular grain emulsions with mean ECD's of less than 3.0 $\mu$m and preferably less than 2.5 $\mu$m.

The radiation-sensitive silver halide grains in the imaging hydrophilic colloid layer unit have coefficients of variation of less than 15 percent and preferably less than 10 percent. These relatively low levels of grain ECD dispersity provide an essential contribution toward satisfying characteristic (7) above.

Tabular grain emulsions satisfying the requirements of the invention can be prepared with low coefficients of variation by employing techniques such as those taught by *Research Disclosure,* Item 38957, I. Emulsion grains and their preparation, E. Blends, layers and performance characteristics, paragraph (2). Preferred emulsion precipitations that produce tabular grain emulsions with COV's of less than 15 percent and, in preferred forms, less than 10 percent, are disclosed by Tsaur et al U.S. Patent Nos. 5,147,771, 5,147,772, 5,147,773 and 5,210,013; Kim et al U.S. Patent Nos. 5,236,817 and 5,272,048; Sutton et al U.S. Patent Nos. 5,300,413; and Mignot et al U.S. Patent Nos. 5,484,697, the disclosures of which are here incorporated by reference. Each of the Tsaur et al and Kim et al patents incorporated by reference in this paragraph explicitly disclose the tabular grains to contain parallel twin planes.

The choice of low coefficient of variation tabular grain emulsions contributes to achieving mid-scale and lower scale contrasts useful for mammography, but in itself does not allow mid-scale contrasts of greater than 3.0 and lower contrasts of greater than 2.2, required for acceptable mammographic imaging, to be realized.

It has been discovered quite unexpectedly that the addition of limited amounts of rhodium as a dopant in the radiation-sensitive silver halide grains is capable of increasing mid-scale and lower scale contrasts into acceptable ranges for mammographic imaging without any significant adverse effect on imaging speed. Keller *Science and Technology of Photography,* VCH, New York, 1993, at page 40 states:

> A fundamentally different approach to high gradation values is the doping of the emulsion grains with heavy-metal ion such as those of rhodium, cadmium, lead and bismuth. Doping pushes back the toe of the characteristic curve and produces a steep gradation.

The expression "pushes back the toe" means simply that more light exposure is required before density rises above a minimum level. Whereas the art has heretofore regarded attaining increased contrasts with rhodium incompatible with maintaining high levels of imaging speed, it has been observed that by limiting the rhodium dopant to a normalized molar concentration of less $1\times10^{-7}$ based on silver, no significant reduction is speed is observed.

This observation is particularly important for mammography. For many types of imaging applications a speed reduction attributable to rhodium doping can be readily overcome merely by increasing the mean ECD of the silver halide grains, since it is well known that imaging speed generally increases with increasing mean grain sizes. However, the small sizes of the microcalcifications sought to be identified limit freedom to increase mean grain size, since the latter also increases granularity (image noise). Attempting medical diagnoses with grainy images runs a significant risk of failing to identify the presence of microcalcifications.

It has been discovered quite unexpectedly that contrast enhancement without significant reduction in imaging speed can be realized by limiting the normalized molar concentration of rhodium to less than $1\times10^{-7}$ based on silver. Any lower concentration of rhodium can be employed that raises average and lower scale contrasts above 3.0 and 2.2, respectively. In most instances it is contemplated that rhodium will be present in a normalized molar concentration of at least $1\times10^{-9}$, based on silver, and most typically rhodium normalized molar concentrations in the range of from $5\times10^{-9}$ to $5\times10^{-8}$ based on silver are preferred.

Any conventional rhodium compound known to be useful in doping silver halide grains can be employed in the practice of the invention. A variety of rhodium and other conventional silver halide grain dopants are disclosed by *Research Disclosure,* Item 38957, I. Emulsions and their preparation, D. Grain modifying conditions and adjustments, paragraphs (3), (4) and (5). Rhodium can be introduced as a simple salt, preferably a halide salt. It is now believed rhodium forms a hexacoordination complex prior to incorporation in the crystal lattice of a silver halide grain. Thus, in most instances rhodium hexahalides are preferred dopants, with up to two halide atoms being sometimes replaced with aquo ligands. Preferred halides in the rhodium compounds are chloride and bromide. Paragraphs (4) and (5) provide specific illustrations of other ligands, including organic ligands, that can be present in rhodium hexacoordination complexes.

Rhodium dopants are compatible with other conventional dopants. Combinations of rhodium and speed increasing dopants, particularly shallow electron trapping dopants, such as those described in *Research Disclosure,* Vol. 367, November 1994, Item 36736, and Olm et al U.S. Patent No. 5,503,970, here incorporated by reference, are specifically contemplated. Conventional iridium dopants can also be employed in combination with rhodium dopants. Iridium dopants, like rhodium dopants, are believed to enter the silver halide grain crystal lattice as hexacoordination complexes, most commonly iridium hexahalide coordination complexes.

When tabular grain emulsions satisfying the requirements set forth above are employed, total silver coating coverages in the range of greater than 35 are capable upon processing of producing a silver image having a maximum density greater than 3.6. It is preferred to employ silver coating coverages in the range of from >35 to 60 mg/dm$^2$. Higher silver coating coverages are unnecessary, since maximum densities greater than 4 do provide additional visually accessible image information.

Maintaining a single sided format (radiation-sensitive silver halide grains on only one side of the support) makes a major contribution to toward image sharpness, characteristic (1) above. In addition, tabular grains contribute to a further increase in image sharpness. Kofron et al U.S. Patent No. 4,439,520 demonstrates the ability to achieve higher levels of image sharpness with tabular grain emulsions than non-tabular grain emulsions.

By specific tabular grain features, described above, the contrast requirements of mammographic radiographic elements have for the first time been realized with tabular grains. In other words, characteristic (7) has been realized for the first time with a tabular grain emulsion. With this discovery it has now become possible to satisfy the full forehardening (3), maximum density (4), less than 60 second processing (5), and low wet pressure sensitivity characteristics that could not otherwise all simultaneously satisfied by employing conventional non-tabular grain emulsions. Thus, a unique mammographic element construction has been provided with unique and advantageous performance characteristics.

Neither the front surface overcoat FSC, the interlayer IL nor the back surface overcoat BSC are required. Any one or combination of FSC, IL and BSC can be omitted while realizing the performance advantages of the invention. These layers in their simplest form can consist of a hydrophilic colloid and are usually provided for physical protection of the underlying hydrophilic colloid layers and to provide a convenient location for inclusion of optional addenda.

Specific selections of remaining features of the radiographic element RE can take any convenient conventional form compatible with the descriptions provided. For example, chemical sensitization of the emulsions is disclosed in *Research Disclosure,* Item 38957, Section IV. Chemical sensitization and *Research Disclosure,* Item 18431, Section I.C. Chemical Sensitization/Doped Crystals. Spectral sensitization of the radiation-sensitive tabular grain emulsions to match peak light emissions from an intensifying screen can be accomplished as disclosed in *Research Disclosure,* Item 18431, Section X. Spectral Sensitization. Specific selections of conventional spectral sensitizing dyes are disclosed in *Research Disclosure,* Item 38957, V. Spectral sensitization and desensitization, A. Spectral sensitizing dyes. The chemical and spectral sensitization of tabular grain emulsions is more particularly taught in Kofron et al U.S. Patent No. 4,429,520, here incorporated by reference.

The following sections of *Research Disclosure,* Item 18431 summarize additional features that are applicable to the radiographic elements of the invention:

II. Emulsion Stabilizers, Antifoggants and Antikinking Agents

III. Antistatic Agents/Layers

IV. Overcoat Layers

The following sections of *Research Disclosure,* Item 38957 summarize additional features that are applicable to the radiographic elements of the invention:

VII. Antifoggants and stabilizers

IX. Coating physical property modifying addenda

A. Coating aids

B. Plasticizers and lubricants

C. Antistats

D. Matting Agents

EXAMPLES

The invention can be better appreciated by consideration in connection with the following specific embodiments. The letters C and E are appended to element numbers to differentiate control and example radiographic elements. All coating coverages are in mg/dm$^2$, except as otherwise indicated.

Radiographic Element A (Control)

A conventional single-side mammographic element was provided having the following format:

Surface Overcoat (SOC)
interlayer (IL)
Emulsion Layer (EL)
Transparent Film Support
Pelloid Layer (PL)
Surface Overcoat (SOC)
Surface Overcoat (SOC)

| Contents | Coverage |
|---|---|
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

Interlayer (IL)

| Contents | Coverage |
|---|---|
| Gelatin | 3.4 |
| AgI Lippmann | 0.11 |
| Carboxymethyl casein | 0.57 |
| Colloidai silica | 0.57 |
| Polyacrylamide | 0.57 |
| Chrome alum | 0.025 |
| Resorcinol | 0.058 |
| Nitron | 0.044 |

Emulsion Layer (EL)

| Contents | Coverage |
|---|---|
| Ag | 43.0 |
| Gelatin | 43.0 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsuffonylmethyl)ether | 0.7% |

(based on wt. of gelatin in all layers of the imaging hydrophilic colloid layer unit)

Pelloid Layer

| Contents | Coverage |
|---|---|
| Gelatin | 43.0 |
| Dye AH-1 | 2.4 |
| Dye AH-2 | 1.1 |
| Dye AH-3 | 0.8 |
| Dye AH-4 | 6.9 |
| Bis(vinylsuffonylmethyl)ether | 2.4% |

(based on wt. of gelatin in the antihalation hydrophilic colloid layer unit)

The transparent film support was a blue tinted 7 mil (177.8 $\mu$m) transparent polyester film support.

The silver halide emulsion employed was a green sensitized silver iodobromide emulsion containing 1 mole percent iodide, based on silver. The silver halide grains were non-tabular and exhibited a mean ECD of 0.7 μm. The emulsion was chemically sensitized with sodium thiosulfate, potassium tetrachloroaurate, sodium thiocyanate and potassium selenocyanate and spectrally sensitized with 170 mg/Ag mol of anhydro-5,5-dichloro-9-ethyl-3,3'-bis(3-sulfopropyl) oxacarbocyanine hydroxide (Dye SS-1).

The four antihalation dyes were employed:

AH-1. Bis[3-methyl-1-(p-sulfophenyl)-2-pyrazolin-5-one-(4)]monomethineoxonol.

AH-2. Bis(1-butyl-3-carboxymethyl-5-barbituric acid) trimethineoxonol.

AH-3. 4-[4-(3-ethyl-2(3H)-benzoxazolylidene-2-butenylidene]-3-methyl-1 -p-sulfophenyl-2-pyrazolin-5-one, monosulfonated.

AH-4. Bis[3-methyl-1-(p-sulfophenyl)-2-pyrazolin-5-one-(4)]pentamethineoxonol.

Radiographic Element B (Example)

Radiographic element B was identical to radiographic element A, except that a tabular grain emulsion, Emulsion T, was substituted for the non-tabular grain emulsion and the level of hardener in the imaging hydrophilic colloid layer unit was increased to 2.4 percent, based on total gelatin in this layer unit.

Emulsion T was precipitated in the following manner: In an 18 liter reaction vessel was placed an aqueous gelatin solution composed of 6 L of water, 7.5 g of alkali processed gelatin treated with an oxidizing agent to reduce methionine (hereinafter referred to as oxidized gelatin), 8.9 mL of 4M nitric acid solution, 3.8 g of sodium bromide, and 0.60 g of Pluronic™ 31R1, which satisfies the formula:

$HO—[CH(CH_3)CH_2O]x—(CH_2CH_2O)y—[CH_2(CH_3)CH]x'—H$ x and x' each=25 and y=7.

At 45° C., 50 mL of a 0.50M aqueous silver nitrate solution and 49 mL of a 0.53M aqueous sodium bromide solution were simultaneously added over a period of 1 minute at a constant rate. Then, 115 mL of a 1M aqueous sodium bromide solution was added to the mixture. After 1 minute of mixing, the temperature was raised to 60° C. over a period of 9 minutes. At that time 100 mL of 1.15M aqueous ammonium sulfate solution and 130 mL of a 2.5M sodium hydroxide solution were added. The mixture was stirred for a period of 9 minutes. Then, to the mixture was added 1.5 L of an aqueous gelatin solution composed of 100 g of oxidized gelatin, 25.52 mL of a 4M nitric acid solution, and 0.15 g of Pluronic™ 31R1. The mixture was stirred for a period of 2 minutes. Thereafter, 150 mL of a 0.50M aqueous silver nitrate solution, and 155 mL of a 0.53M aqueous sodium bromide solution were simultaneously added at a constant rate for a period of 10 minutes. Then, 2.92 L of a 2.60M aqueous silver nitrate solution and 2.90 L of a 2.68M aqueous sodium bromide solution containing 0.86 mL of a 0.146 mM aqueous ammonium hexachlororhodate(III) solution were simultaneously added to the mixture at a constant ramp starting from respective rates of 5.0 mL/min and 5.2 mL/min for the subsequent 79 minutes. Then 1.39 L of a 2.6M aqueous silver nitrate solution and 1.38 L of a 2.68M aqueous sodium bromide solution with 0.45 mL of 0.146 mM aqueous ammonium hexachlororhodate(III) were simultaneously added to the mixture at a constant rate over a period of 20.2 minutes, and 1.2 minutes into this period 2 mL of a 0.12 mM solution potassium hexachloroiridate(IV) solution was added over a period of 2 minutes. The emulsion was then washed.

Emulsion T, a tabular grain silver bromide emulsion, had a mean grain ECD of 2.0 μm and a mean grain thickness of 0.13 μm. Tabular grains accounted for greater than 90 percent of total grain projected area, and the grain size COV of the emulsion was 7 percent. The silver bromide grains were doped with $9.7\times10^{-9}$ mole per silver mole of rhodium to increase contrast without significantly reducing speed. Iridium was added as a dopant to reduce reciprocity failure, since mammographic films in varied uses receive widely varying exposure times.

The tabular grain emulsion was chemically sensitized with sodium thiosulfate, potassium tetrachloroaurate, sodium thiocyanate and potassium selenocyanate and spectrally sensitized with 400 mg/Ag mol of Dye SS-1, followed by 300 mg/Ag mol of potassium iodide.

Radiographic Element C (Control)

This radiographic element was constructed identically as example radiographic element B, except that the rhodium dopant was omitted from the silver bromide grains. The tabular grains exhibited a mean ECD of 1.8 μm and a COV of 10 percent.

Radiographic Element D (Control)

This radiographic element was constructed identically as radiographic element C, except that the tabular grain emulsion employed exhibited a mean ECD of 2.0 μm and a mean grain size dispersity COV of 38 percent.

EVALUATIONS

Samples of the elements were simultaneously exposed on the emulsion side only for ½ sec through a graduated density step tablet using a MacBeth™ sensitometer having a 500 watt General Electric DMX™ projector lamp calibrated to 2650° K. and filtered through a Coming C4010™ filter (480–600 nm, 530 nm peak transmission).

The samples were processed using a Kodak X-Omat RA 480 processor. This processor can be set to any one of the overall processing cycles set out in Table I.

TABLE I

| | Cycle Times in Seconds | | | | |
|---|---|---|---|---|---|
| Cycle | Extended | Standard | Rapid | KWIK | Super KWIK |
| Develop | 449 | 27.6 | 15.1 | 11.1 | 8.3 |
| Fix | 37.5 | 18.3 | 12.9 | 9.4 | 7.0 |
| Wash | 30.1 | 15.5 | 10.4 | 7.6 | 5.6 |
| Dry | 47.5 | 21.0 | 16.6 | 12.2 | 9.1 |
| Total | 160.0 | 82.4 | 55 | 40.3 | 30.0 |

The processing cycles employed the following developers and fixers, where component concentrations are expressed in g/L:

| | |
|---|---|
| Hydroquinone | 30 |
| 4-Hydroxymethyl-4-methyl-1-phenyl-3-pyrazolidinone | 1.5 |
| Potassium hydroxide | 21.00 |
| S-Methylbenzotriazole | 0.06 |
| Sodium bicarbonate | 7.5 |
| Potassium sulfite | 44.2 |
| Sodium metabisulfite | 12.6 |

-continued

| | |
|---|---|
| Sodium bromide | 35.0 |
| Glutaraldehyde | 4.9 |
| Water to 1 liter | |
| pH 10 | |

The glutaraldehyde functioned to complete hardening of Element A, but had little effect on the remaining elements, which were fully forehardened.

| Extended, Standard and Rapid fixer: | |
|---|---|
| Ammonium thiosulfate, 60% | 260 |
| Sodium bisulfite | 180 |
| Boric acid | 25 |
| Acetic acid | 10 |
| Aluminum sulfate | 8 |
| Water to 1 liter | |
| pH 3.9 to 4.5 | |
| **KwiK developer:** | |
| Hydroquinone | 32 |
| 4-Hydroxymethyl-4-methyl-1-phenyl-3-pyrazolidinone | 6.0 |
| Potassium bromide | 2.25 |
| S-Methylbenzotriazole | 0.125 |
| Sodium sulfite | 160 |
| Glutaraldehyde | 4.9 |
| Water to 1 liter | |
| pH 10.5 | |
| **Kwik fixer:** | |
| Potassium hydroxide | 3.2 |
| Glacial acetic acid | 9.6 |
| Ammonium thiosulfate | 100 |
| Ammonium sulfite | 7.1 |
| Sodium tetraborate pentahydrate | 4.4 |
| Tartaric acid | 3.0 |
| Sodium metabisulfite | 6.6 |
| Aluminum sulfate | 3.3 |
| Water to 1 liter | |
| pH 4.9 | |
| **Super Kwik developer:** | |
| Potassium hydroxide | 23 |
| Sodium sulfite | 12 |
| 1-Phenyl-5-mercaptotetrazole | 0.02 |
| Sequestrant* | 2.8 |
| Sodium bicarbonate | 7.4 |
| Potassium sulfite | 70.8 |
| Diethylene glycol | 15 |
| Hydroquinone | 30 |
| Glutaraldehyde | 3.9 |
| Glacial acetic acid | 10 |
| 1-Phenyl-3-pyrazolidone | 12 |
| 5-nitroindazole | 0.12 |
| Water to 1 liter | |
| pH 10.6 | |
| *diethylenetriaminopentaacetic acid pentasodium salt | |
| **Super Kwik fixer:** | |
| Potassium hydroxide | 7.4 |
| Acetic acid | 18 |
| Sodium thiosulfate | 16 |
| Potassium iodide | 122 |
| Ammonium sulfite | 8.6 |
| Sodium metabisulfite | 2.9 |
| Sodium glutonate | 5.0 |
| Aluminum sulfate | 7.0 |
| Water to 1 liter | |
| pH 4.7 | |

The glutaraldehyde functioned to complete hardening of Element A, but had little effect on the remaining elements, which were fully forehardened.

To compare the ability of the processor to dry the film samples, samples of the Elements were flash exposed to provide a density of 1.0 when processed. As each film sample started to exit the processor, the processor was stopped, and the sample was removed from the processor. Roller marks were visible on the film in areas that had not dried. A film that was not dry as it left the processor was assigned a % dryer value of 100+. A film that exhibited roller marks from first encountered guide rollers, but not the later encountered guide rollers, indicating that the film had already dried when passing over the latter rollers, was assigned a % dryer value indicative of percentage of the rollers that were guiding undried portions of the film. Hence lower % dryer values indicate quicker drying film samples.

Significant performance characteristics are summarized in Table II.

TABLE II

| | | | Process Cycle | | |
|---|---|---|---|---|---|
| Element | MSC | LSC | 55" | 40" | 30" |
| A | 3.2 | 2.3 | >100% | >100% | >100% |
| B | 3.6 | 2.4 | 80% | >100% | >100% |
| C | 2.6 | 2.0 | 80% | >100% | >100% |
| D | 2.1 | 1.9 | 80% | >100% | >100% |

All of the elements exhibited essentially similar speeds (differing by ≦0.03 log E) measured at a density of 1.0 above minimum density. The fact that the rhodium dopant in Element B was able to increase contrast without lowering speed was surprising.

All of the elements produced maximum densities of greater than 3.6. None of the elements exhibited wet pressure sensitivity, despite the lower levels of gelatin employed in the elements containing tabular grain emulsions.

Only Element B, satisfying the requirements of the invention, and conventional mammographic film Element A were capable of producing a mid-scale contrast (MSC) of greater than 3.0 and a lower scale contrast (LSC) of greater than 2.2, as required for acceptable quality mammographic imaging. From Elements C and D it is apparent that a combination of tabular grains having low grain size dispersity COV and rhodium doping was required to achieve this performance capability.

Only Element B, satisfying the requirements of the invention, was capable of both satisfying mammographic imaging requirements and undergoing overall processing in less than 60 seconds.

The invention has been described in detail with particular reference to preferred embodiments thereof, but it will be understood that variations and modifications can be effected within the spirit and scope of the invention.

What is claimed is:

1. A medical diagnostic radiographic element comprised of a film support capable of transmitting radiation to which the radiographic element is responsive having first and second major surfaces, hydrophilic colloid layer units consisting of an imaging layer unit coated on the first major surface including at least one emulsion containing radiation-sensitive silver halide grains and an antihalation layer unit coated on the second major surface, wherein, to facilitate mammographic imaging with processing times of less than 60 seconds, the silver halide grains are chosen from among silver bromide, silver iodobromide, silver chlorobromide and silver iodochlorobromide grains containing less than 4 mole percent iodide, based on silver, said layer units are fully forehardened and each exhibits a hydrophilic colloid coating coverage of less than 55 $mg/dm^2$ and said radiation-sensitive silver halide grains are provided by a tabular grain emulsion in which the tabular grains have parallel twin planes and are coated at a coverage capable of providing a maximum density on processing of greater than 3.6 and, to provide a mid-scale contrast of greater than 3.0 and a lower scale contrast of greater than 2.2, said grains (a) exhibit an equivalent circular diameter coefficient of variation of less than 15 percent and (b) contain rhodium in a normalized molar concentration of less than $1\times10^{-7}$ based on silver, mid-scale contrast being measured over a density range above minimum density of from 0.25 to 2.0 and lower scale contrast being measured from a reference density of 0.85 above minimum density to a density provided by an exposure of 0.3 log E less than that providing the reference density, where E represents exposure in lux-seconds.

2. A mammographic imaging radiographic element according to claim 1 wherein the radiation-sensitive silver halide grains exhibit a coefficient of variation of less than 10 percent.

3. A mammographic imaging radiographic element according to claim 1 wherein the rhodium dopant is present in a normalized molar concentration greater than $1\times10^{-9}$ based on silver.

4. A mammographic imaging radiographic element according to claim 3 wherein the rhodium dopant is present in a normalized molar concentration in the range of from $5\times10^{-9}$ to $1\times10^{-8}$ based on silver.

5. A mammographic imaging radiographic element according to claim 1 wherein the tabular grains have an average thickness of at least 0.1 $\mu$m.

6. A mammographic imaging radiographic element according to claim 1 wherein the tabular grains having a thickness of less than 0.2 $\mu$m account for at least 70 percent of total grain projected area.

7. A mammographic imaging radiographic element according to claim 1 wherein the radiographic element can be processed by the following processing cycle:

| | |
|---|---|
| development | 15.1 seconds |
| fixing | 12.9 seconds |
| washing | 10.4 seconds |
| drying | 16.6 seconds |

employing a hydroquinone-pyrazolidinone developer.

* * * * *